US005408767A

United States Patent [19]

Hazama et al.

[11] Patent Number: 5,408,767

[45] Date of Patent: Apr. 25, 1995

[54] EXCAVATION CONTROLLING APPARATUS FOR DIPPER SHOVEL

[75] Inventors: Hiroyoshi Hazama; Hideo Arimitsu; Kengo Nakamura, all of Takasago, Japan

[73] Assignee: Kabushiki Kaisha Kobe Seiko Sho, Kobe, Japan

[21] Appl. No.: 79,493

[22] Filed: Jun. 21, 1993

[30] Foreign Application Priority Data

Jul. 9, 1992 [JP] Japan ..... 4-182592

[51] Int. Cl.[6] ..... B66C 23/00; E02F 3/46

[52] U.S. Cl. ..... 37/396; 37/384; 37/394; 37/395; 364/167.01; 364/424.07; 364/506; 414/694; 414/699; 414/718; 414/728

[58] Field of Search ..... 37/384, 394, 395, 396; 364/167.01, 424.07, 506; 414/694, 699, 718, 728

[56] References Cited

U.S. PATENT DOCUMENTS 3,144,146 8/1964 Strickland, Jr. ..... 37/348 X

FOREIGN PATENT DOCUMENTS 609848 6/1978 U.S.S.R. ..... 37/396
1105577 7/1984 U.S.S.R. ..... 37/396
1146380 3/1985 U.S.S.R. ..... 37/396
1364669 1/1988 U.S.S.R. ..... 414/699
1416624 8/1988 U.S.S.R. ..... 37/348

*Primary Examiner*—Dennis L. Taylor
*Assistant Examiner*—Andrea Chop
*Attorney, Agent, or Firm*—Oblon, Spivak, McClelland, Maier & Neustadt

[57] ABSTRACT

An excavation controlling apparatus which can effect precise driving control off a dipper in accordance with an actual operation condition with a simple structure of a low cost. A dipper handle extension instruction calculation section calculates a dipper handle extension instruction signal from a difference between a moment upper limit value set by a moment limit value setting section and a working moment calculated by a working moment calculation section, and causes a dipper handle driving motor output controlling apparatus to control a sliding driving operation of a dipper handle in accordance with the dipper handle extension instruction signal. A hoisting operation instruction calculation section corrects a hoisting operation reference instruction set by a hoisting operation reference instruction setting section with the moment upper limit value and a hoisting operation instruction correction amount calculated from the working moment. A hoisting motor output controlling apparatus performs hoisting control based on the thus corrected hoisting operation instruction.

4 Claims, 5 Drawing Sheets

EXCAVATION CONTROLLING APPARATUS FOR DIPPER SHOVEL

BACKGROUND OF THE INVENTION

1. Field of the Invention

This invention relates to an apparatus for automatically controlling an excavation operation of a dipper shovel of the type wherein a dipper and a supporting member for the dipper are driven to slidably move and are driven to rotate by a taking up operation of a hoisting member.

2. Description of the Related Art

Conventional dipper shovels are commonly constructed such that a boom is provided on a front face of a body and a dipper handle (dipper supporting member) and a dipper are supported for sliding movement and pivotal motion on the boom, and sliding movements of the dipper and the dipper handle and pivoting operations of the dipper and the dipper handle by taking up of a rope are performed simultaneously to perform hoisting by means of the dipper. An exemplary one of the conventional dipper shovels is disclosed, for example, in Japanese Patent Laid-Open Application No. Showa 62-1931.

Operation of a dipper shovel of the type mentioned is normally performed by manual operation based on feelings of its operator. However, such operation of the dipper by manual operation requires considerable skill and imposes a considerable burden on the operator. Meanwhile, even if the operation is performed by a skilled operator, it may not always proceed efficiently. Particularly when the dipper bites excessively into an object for excavation, the burden in strength on the dipper increases remarkably and the operation speed of the dipper is liable to drop to deteriorate the operation efficiency. Accordingly, it is demanded to develop an apparatus for automatically controlling an excavating operation of a dipper shovel precisely with a simple structure of a low cost.

It is to be noted that, while Japanese Patent Laid-Open Application No. Showa 62-1931 mentioned above proposes a method of suitably setting the position of the center of pivotal motion of the dipper handle and the extruding force to the dipper, it does not disclose details of automatic hoisting control of the dipper shovel.

SUMMARY OF THE INVENTION

It is an object of the present invention to provide an excavation controlling apparatus which can effect precise driving control of a dipper in accordance with an actual operation condition with a simple structure of a low cost.

Generally in a dipper shovel of the type described above, as the excavation resistance increases, the moment acting upon the dipper increases, and in an ordinary excavation condition, as the biting extent of the dipper into an object for excavation increases, the excavation resistance increases. Accordingly, various discrimination articles in operation of the dipper such as discrimination of the profile and the hardness of the object for excavation and discrimination of the biting amount can be replaced with a discrimination in magnitude of the operation moment acting upon the dipper. For example, when an ordinary hoisting operation is performed by a dipper shovel, the relationship between the angle of pivotal motion of the dipper supporting member and an excavation moment value suitable to the angle in pivotal motion is substantially such as illustrated in FIG. 7.

The present invention has been made taking notice of the fact described above, and according to the present invention, there is provided an excavation controlling apparatus for a dipper shovel which includes a dipper, a dipper supporting member having the dipper supported at an end thereof, a boom for supporting the dipper supporting member for sliding movement in its longitudinal direction and also for pivotal motion around an axis of a direction perpendicular to the direction of the sliding movement, dipper supporting member driving means for driving the dipper supporting member to slidably move in the longitudinal direction, a body for supporting the boom thereon, a hoisting member connected to the dipper supporting member at a position displaced from the axis of the pivotal motion and extending around an end of the boom, and hoisting means for taking up the hoisting member to pivot the dipper and the dipper supporting member upwardly, the excavation controlling apparatus comprising dipper supporting member angle detection means for detecting a dipper supporting member angle which is an angle of the dipper supporting member in its pivoting direction, dipper supporting member position detection means for detecting a slide position of the dipper supporting member in its direction of sliding movement, dipper posture calculation means for calculating a posture of the dipper based on detection values from the dipper supporting member angle detection means and the dipper supporting member position detection means, hoisting force detection means for detecting a hoisting force of the dipper by the hoisting means, moment calculation means for momentarily calculating a working moment of the dipper supporting member around the axis of the pivotal motion from a dipper posture from the dipper posture calculation means and the hoisting force from the hoisting force detection means, moment limit value setting means for setting a moment upper limit value in response to the dipper supporting member angle from the dipper supporting member angle detection means, dipper supporting member driving control means for comparing a moment limit value set by the moment limit value setting means and the working moment calculated by the moment calculation means with each other and controlling driving of the dipper supporting member driving means in accordance with a result of the comparison, and hoisting controlling means for comparing the moment limit value and the working moment calculated by the moment calculation means and controlling the hoisting operation of the hoisting means in accordance with a result of the comparison.

With the excavation controlling apparatus, if the biting amount of the dipper of the dipper shovel becomes excessively great or the dipper hits upon a locally solid portion of an object for excavation, then the excavation resistance increases, and also the working moment calculated then becomes high. Since the sliding driving operation and the hoisting operation of the dipper are controlled based on the magnitude of the working moment, automatic excavation control conforming to an actual excavation condition is realized.

Here, since the excavation controlling apparatus controls, taking notice of the working moment of the dipper which corresponds well to an actual excavation condition, the sliding operation and the hoisting operation of the dipper supporting member based on a result of comparison between the working moment and the preset moment limit value, excavation by the dipper can be automatically controlled precisely with the excavation controlling apparatus of a simple structure of a low cost which employs a small number of detectors for detecting the working moment. Accordingly, the excavation controlling apparatus is advantageous in that the burden on the operator can be decreased remarkably and a high operation efficiency can be obtained stably.

Preferably, the excavation controlling apparatus for a dipper shovel further comprises externally operable moment limit value adjustment means for modifying the moment limit value set by the moment limit value setting means. Thus, by modifying the moment limit value conforming to the nature of the soil or some other factor by external operation of the moment limit value adjustment means, the single excavation controlling apparatus can cope well with various excavation conditions and good excavation can automatically be performed in various conditions and for various grounds.

Preferably, the moment limit value setting means simultaneously sets both of a moment upper limit value and a moment lower limit value. Thus, when the bottom of the dipper is acted upon by a reactive force from the ground as a result of excessive extension of the dipper or by some other reason so that the moment calculated by the moment calculation means is decreased, the sliding driving operation and the hoisting driving operation of the dipper supporting member are controlled based on a result of comparison between the calculated moment and the moment lower limit value calculated by the moment limit value setting setting means, and consequently, such a trouble as jacking up of the the entire dipper shovel or insufficient excavation can be prevented effectively.

Alternatively, the moment limit value setting means may simultaneously set both of a moment limit value for dipper supporting member driving control used for driving control of the dipper supporting member driving means and another moment limit value for hoisting control used for hoisting control such that the moment limit value for hoisting control is higher than the moment limit value for dipper supporting member driving control. Since the moment upper limit value for hoisting control is set higher than the moment upper limit value for driving control of the dipper supporting member, when the excavation resistance rises, the dipper shovel can cope with the situation basically by restricting the extending operation of the dipper supporting member, and if such adjustment is not sufficient, the hoisting operation can be made slower using the moment limit value for dipper supporting member driving control. Consequently, the hoisting speed can be kept high while assuring good excavation, and the cycle time can be minimized.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 2:
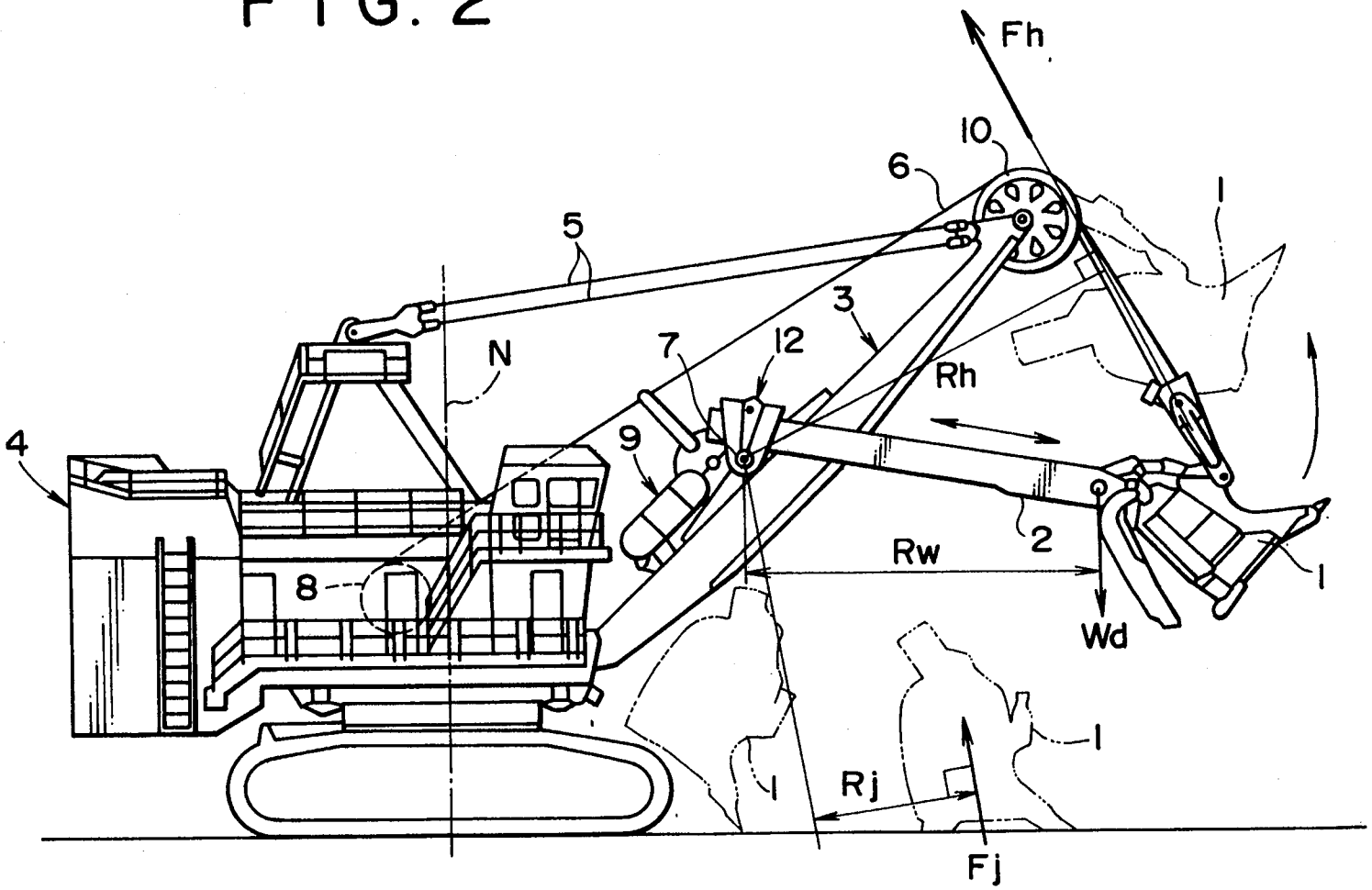
FIG. 2 is a side elevational view of an entire dipper shovel in which the excavation controlling apparatus shown in FIG. 1 is incorporated.

Referring first to FIG. 2, there is shown a dipper shovel in which an excavation controlling apparatus according to the present invention is incorporated. The dipper shovel shown includes a dipper 1 mounted at an end of a dipper handle 2 serving as a dipper supporting member. The dipper handle 2 is supported for sliding movement in its longitudinal direction on a saddle block 12. The saddle block 12 is mounted at an intermediate portion of a boom 3 for pivotal motion around a shipper shaft 7 extending in a horizontal direction (direction perpendicular to the plane of FIG. 2). A toothed rack not shown is formed in a horizontal direction on the dipper handle 2 while a pinion not shown is provided on the shipper shaft 7 and is held in meshing engagement with the rack. Consequently, when the pinion is driven by a dipper handle driving apparatus 9 installed on the boom 3 and serving as dipper handle driving means, the dipper handle 2 is driven to slidably move in its extending direction or its contracting direction.

The boom 3 is mounted at a base end thereof for pivotal motion around a horizontal axis on a working machine body 4 and is connected at a free end thereof to a portion of the working machine body 4 by way of a boom supporting rope 5 so that the boom 3 is swung around a vertical axis N together with the working machine body 4. Accordingly, when the boom 3 is acted upon from below by an excessively high upward load, the boom supporting rope 5 is slackened while the boom 3 escapes upwardly.

A hoisting rope 6 serving as a hoisting member is connected to the dipper 1. The hoisting rope 6 extends around a boom point sheave 10 mounted at the free end of the boom 3 and is taken up onto a dipper hoisting apparatus 8 carried on the working machine body 4, and the dipper 1 and the dipper handle 2 are pivoted upwardly by the taking up operation of the hoisting rope 6 by the dipper hoisting apparatus 8.

In the dipper shovel having such construction as described above, the dipper handle 2 is extended suitably while the dipper 1 is hoisted by the hoisting rope 6 so that an excavation operation by the dipper 1 is performed.

Figure 1:
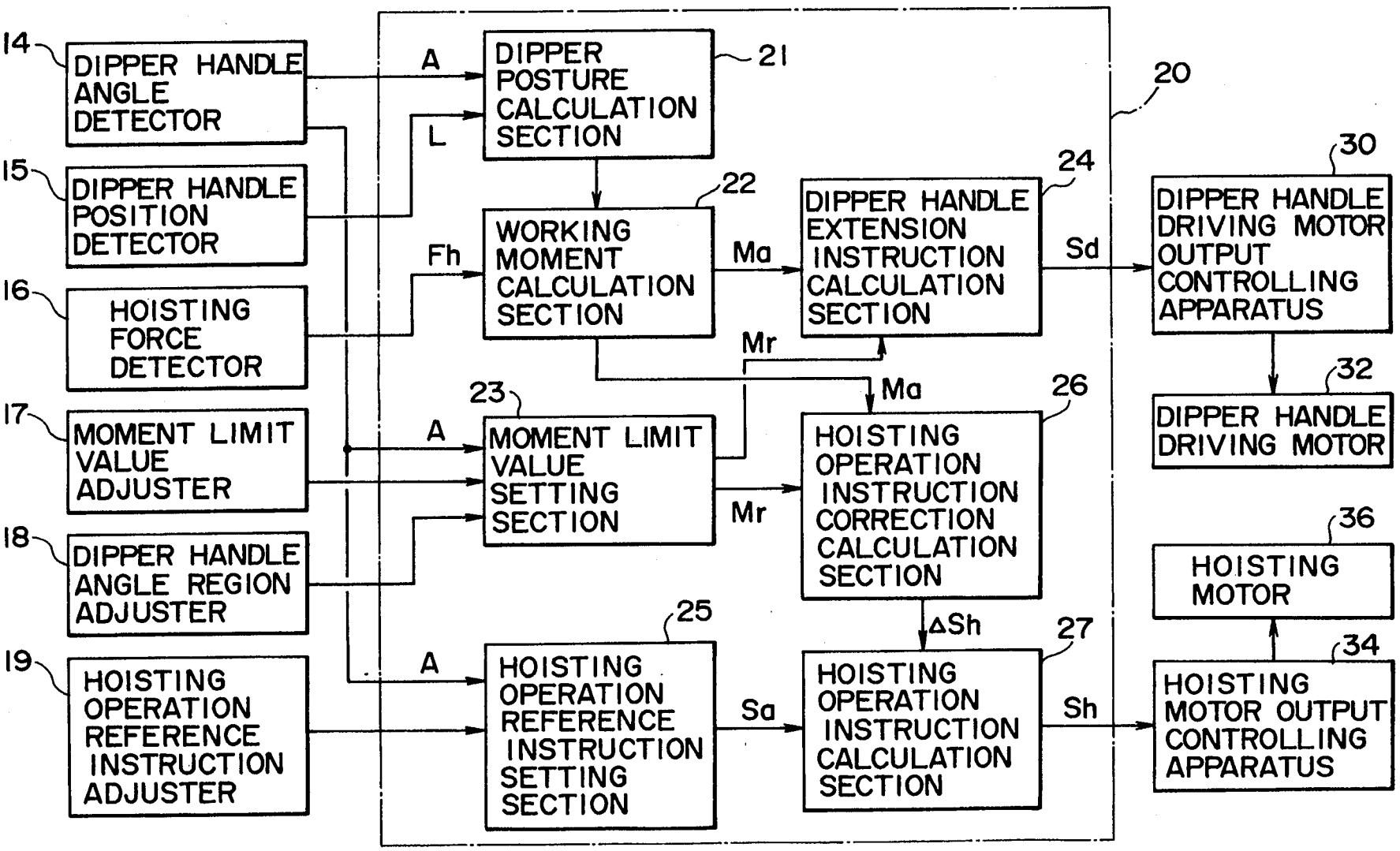
FIG. 1 is a block diagram showing a functional construction of an excavation controlling apparatus for a dipper shovel according to a preferred embodiment of the present invention.

The dipper shovel has various detectors mounted thereon. Referring now to FIG. 1, the detectors include a dipper handle angle detector 14 serving as dipper supporting member angle detection means, a dipper handle position detector 15 serving as dipper supporting member position detection means, and a hoisting force detector 16 serving as hoisting force detection means.

The dipper handle angle detector 14 detects an angle A (hereinafter referred to as dipper handle angle) in pivotal motion of the dipper handle 2 around the shipper shaft 7 with reference to a predetermined angular position. The dipper handle angle detector 14 may be, for example, a ground angle sensor employing a weight or a like element, or a potentiometer or an encoder which detects an angle of the saddle block 12 with respect to the boom 3.

The dipper handle position detector 15 detects an amount L of sliding movement of the dipper handle 2 from a predetermined reference position and may be selected from, for example, a potentiometer of the reel type which detects an actual stroke of the dip handle 2 with respect to the saddle block 12, an ultrasonic sensor which detects the speed of rotation of a pinion gear for driving the dipper handle 2, and an ultrasonic sensor.

The hoisting force detector 16 detects a hoisting force of the hoisting rope 6 provided by the dipper hoisting apparatus 8, that is, the hoisting force Fh of the dipper handle 2. The hoisting force detector 16 may be, for example, a detector which detects the value of current flowing through an electric hoisting motor 36 (refer to FIG. 1) provided for the dipper hoisting apparatus 8, another detector which detects torque of a drum shaft (not shown) of the dipper hoisting apparatus 8, a further detector which detects a strain of a sheave pin (not shown) of the boom point sheave 10 or a still further detector which detects the hoisting force indirectly from the tension of the boom supporting rope 5.

Detection signals of the sensors 14, 15 and 16 are inputted to such a controller 20 as shown in FIG. 1 so that driving of sliding motion and driving of hoisting motion of the dipper 1 and the dipper handle 2 are controlled by the controller 20 based on the detection signals.

The controller 20 includes a dipper posture calculation section 21, a working moment calculation section 22, a moment limit value setting section 23, a dipper handle extension instruction calculation section 24, a hoisting operation reference instruction setting section 25, a hoisting operation instruction correction calculation section 26, and a hoisting operation instruction calculation section 27.

The dipper posture calculation section 21 calculates, based on values detected by the dipper handle angle detector 14 and the dipper handle position detector 15, a dipper posture, or more particularly, a ground angle or an angle with respect to the boom 3 of the dipper handle 2, a moment radius Rh of the hoisting force Fh around the shipper shaft 7 and a moment radius Rw of the self weight Wd of the dipper 1 and dipper handle 2 around the shipper shaft 7.

The working moment calculation section 22 calculates, based on a dipper posture calculated by the dipper posture calculation section 21 and a hoisting force Fh detected by the hoisting force detector 16, an excavation moment or working moment Ma acting upon the dipper 1 around the shipper shaft 7 during an excavation operation. In particular, the working moment Ma is calculated in accordance with the following equation:

$$Ma = Fh \cdot Rh - Wd \cdot Rw$$

Thus, the working moment Ma is calculated as a difference between a moment by the hoisting force Fh and another moment by the self weight Wd.

The moment limit value setting section 23 stores various values of a moment limit value (more particularly, a moment upper limit value) Mr corresponding to various values of a dipper handle angle A as an A-Mr table and sets and outputs a moment upper limit value Mr in response to a dipper handle angle A detected actually by the dipper handle angle detector 14. Further, when a moment limit value adjusting section 17 provided on the driver's seat of the dipper shovel is manually operated externally (i.e., external to the control systems), the moment limit value setting section 23 changes the set magnitude of the moment upper limit Mr in response to an amount of such operation. Furthermore, when a dipper handle angle region adjuster 18 provided similarly on the driver's seat is manually operated externally, the moment limit value setting section 23 changes the angle region of the dipper handle angle, in which the current moment upper limit value Mr is set, in response to an amount of such operation.

Figure 3:
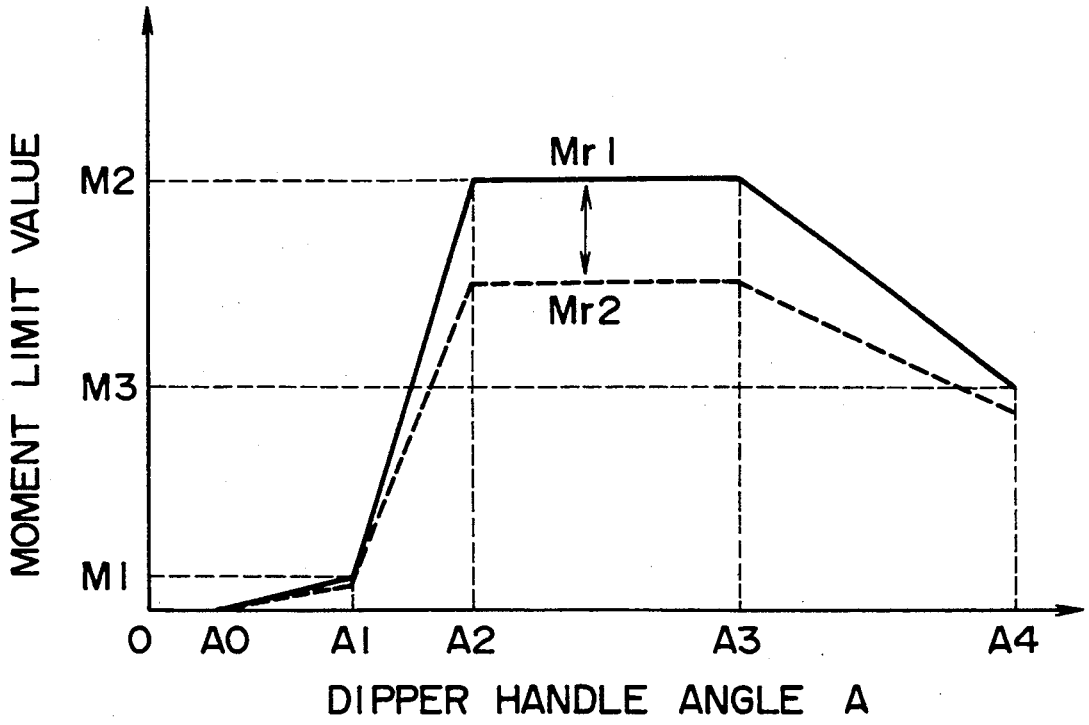
FIG. 3 is a graph of a moment limit value set by the excavation controlling apparatus.

More particularly, the moment limit value setting section 23 stores therein such an A-Mr table wherein the moment upper limit value Mr is different in different angle regions as shown by the graph of FIG. 3, and adjusts, in response to an amount of operation of the moment limit value adjuster 17, the magnitude of the moment upper limit value Mr within the range from a highest value Mr1 indicated by a solid line in FIG. 3 to a lowest value Mr2 indicated by a broken line in FIG. 3. Further, the moment limit value setting section 23 adjusts angles A1, A2, A3 and A4, which are boundary values for the respective angle regions, in response to an amount of operation of the dipper handle angle region adjuster 18.

The moment limit value adjuster 17 and the dipper handle angle region adjuster 18 thus constitute moment limit value adjustment means in the present invention. It is to be noted that each of the adjusters 17 and 18 is not limited to an adjuster of a particular structure, and may be of an adjuster of the type wherein a pattern is selected by means of a change-over switch by an operator or wherein a voltage signal is varied using a potentiometer.

The dipper handle extension instruction calculation section 24 calculates, based on a difference $\Delta M$ ($=Mr-Ma$) between a moment upper limit value Mr set by the moment limit value setting section 23 and an operation moment Ma calculated by the operation moment calculation section 22, a dipper handle extension instruction Sd using the equation below:

$$Sd = f(\Delta M)$$

where $f(\Delta M)$ is a function of a moment difference $\Delta M$ and satisfies the conditions i) $f(\Delta M)=0$ when $\Delta M=0$, ii) $f(\Delta M)>0$ and $d\{f(\Delta M)\}/d(\Delta M)>0$ (monotone increase) when $\Delta M>0$, and iii) $f(\Delta M)<0$ and $d\{f(\Delta M)\}/d(\Delta M)<0$ (monotone decrease) when $\Delta M<0$. A suitable one of various functions including a linear function can be applied as the function $f(\Delta M)$. It is to be noted that the dipper handle extension instruction Sd may be calculated using a PID (proportional plus integral plus derivative) control calculation. The dipper handle extension instruction calculation section 24 outputs the thus calculated dipper handle extension instruction Sd to a dipper handle driving motor output controlling apparatus 30.

The dipper handle driving motor output controlling apparatus 30 executes driving control of a dipper handle driving motor 32 based on a dipper handle extension instruction signal Sd. More particularly, the dipper handle driving motor output controlling apparatus 30 executes driving control of the dipper handle driving motor 32 such that, when the extension instruction signal Sd is in the positive in sign, the dipper handle 2 is moved in its extending direction by an amount corresponding to an absolute value of the extension instruction signal Sd, but when the extension instruction signal Sd is in the negative, the dipper handle 2 is contracted by an amount corresponding to an absolute value of the extension instruction signal Sd.

The dipper handle driving motor output controlling apparatus 30 and the dipper handle extension instruction calculation section 24 thus constitute dipper supporting member driving control means in the present invention.

Figure 4:
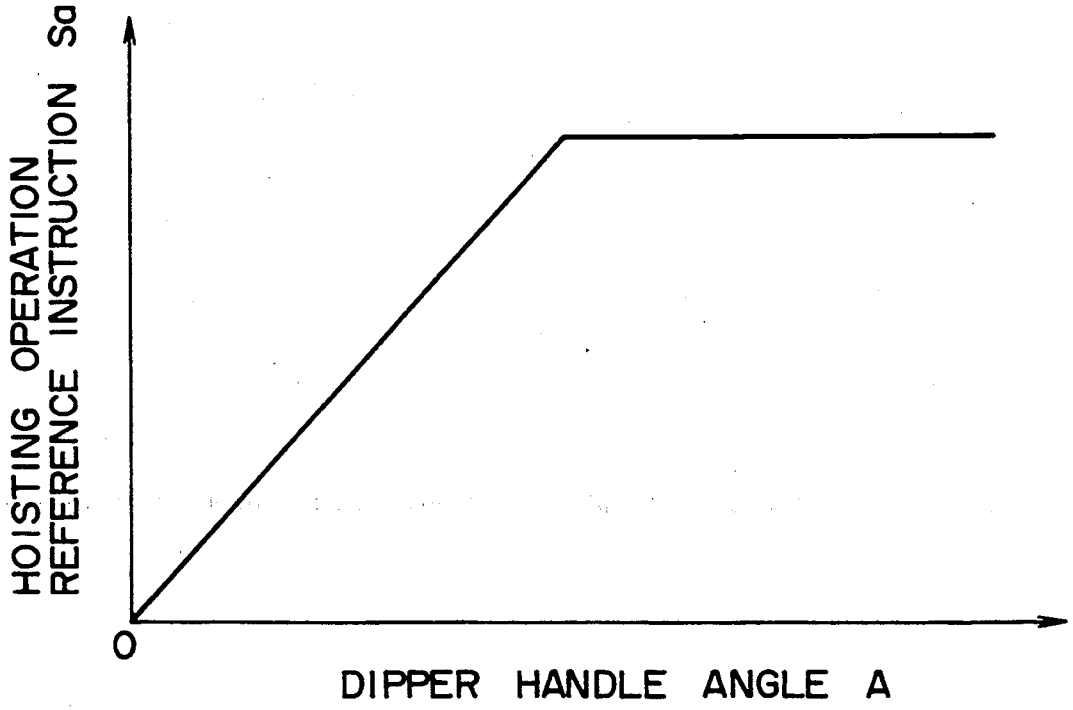
FIG. 4 is a graph illustrating a hoisting operation reference instruction signal set by the excavation controlling apparatus.
Figure 5:
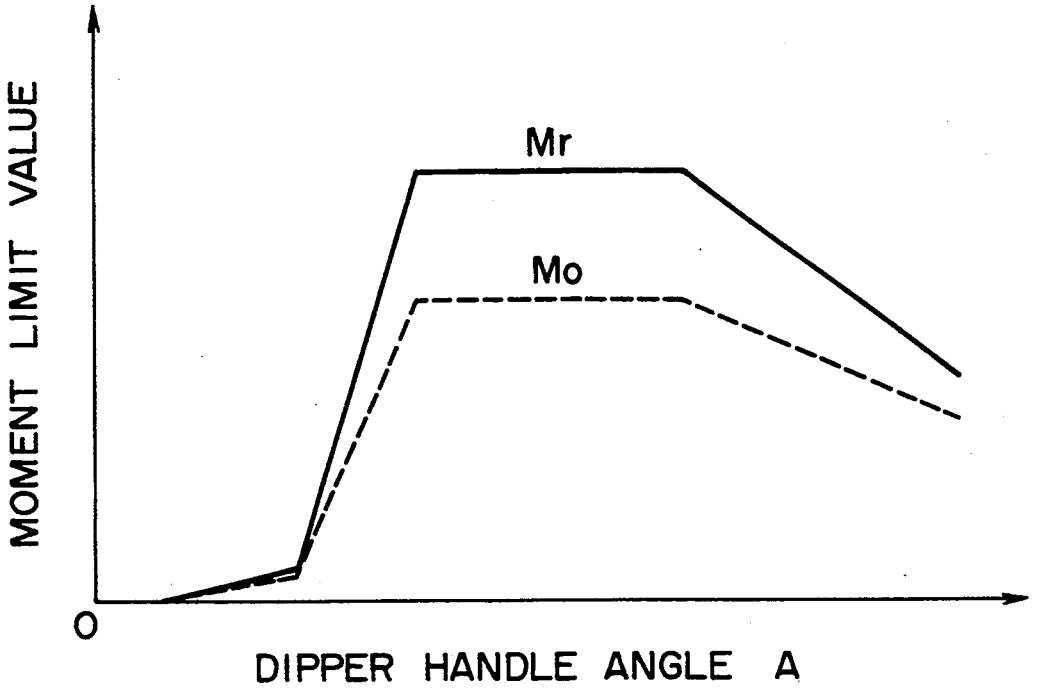
FIGS. 5 and 6 are graphs of different moment limit values set by modified excavation controlling apparatus.
Figure 6:
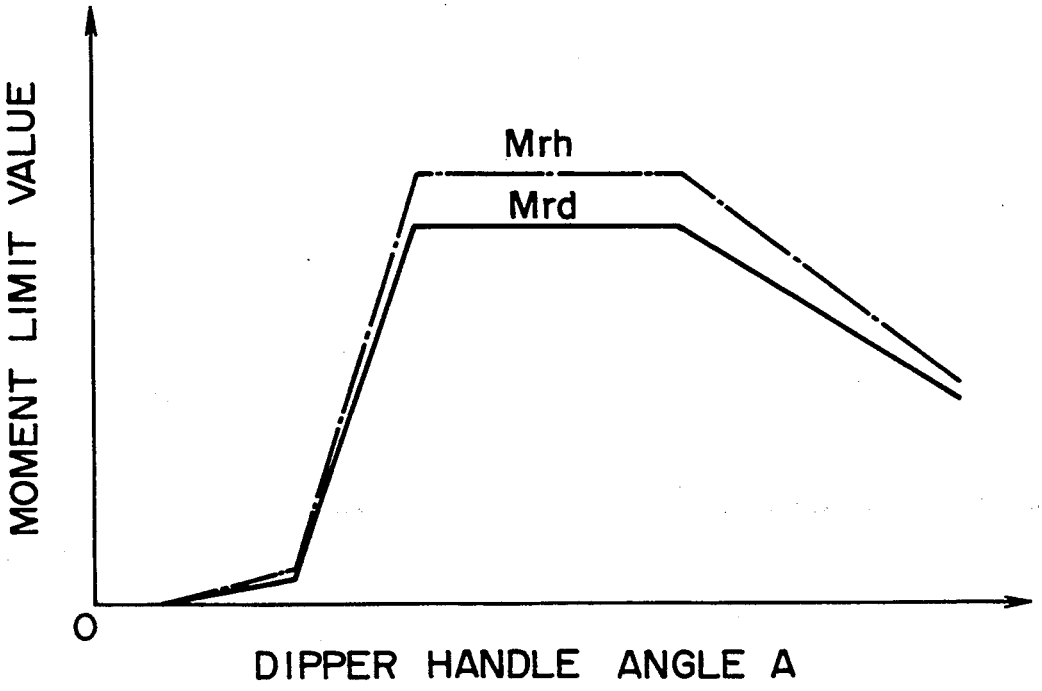
Figure 7:
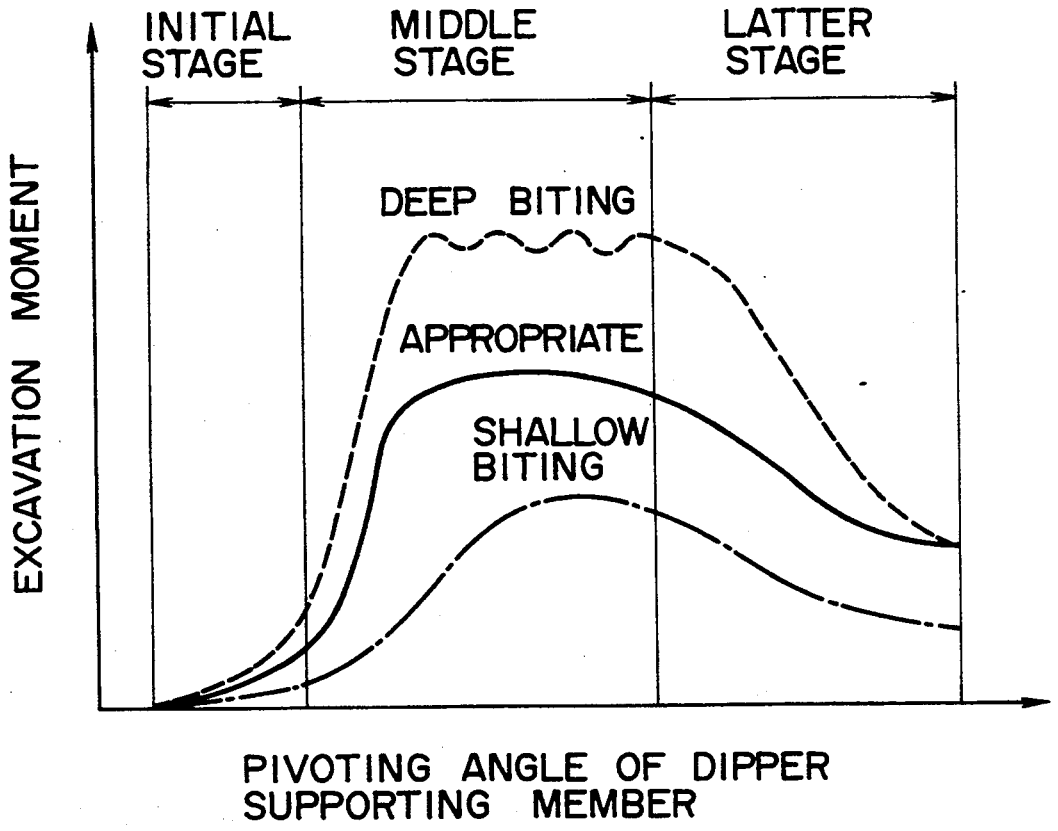
FIG. 7 is a graph illustrating a variation of the excavation moment in an excavation operation of a dipper shovel.

The hoisting operation reference instruction setting section 25 stores different values of an operation reference instruction signal Sa corresponding to different values of the dipper handle angle A in the form of an A-Sa table and sets and outputs a hoisting operation reference instruction signal Sa in response to a dipper handle angle A detected actually by the dipper handle angle detector 14. In the present embodiment, such a table as shown by the graph in FIG. 4 is stored in the hoisting operation reference instruction setting section 25. According to the table, the hoisting operation reference instruction signal Sa is set such that, in the former half of excavation before the dipper handle angle A reaches a predetermined value, the hoisting speed increases continuously from 0, but in the latter half of excavation after a steady movement is established, the hoisting speed is maintained substantially at its highest value.

Contents of the hoisting operation reference instruction Sa are modified by manual operation of a hoisting operation reference instruction adjusting section 19 provided on the driver's seat.

The hoisting operation instruction correction calculation section 26 calculates, based on the difference $\Delta M$ ($=Mr-Ma$) between a moment upper limit value Mr set by the moment limit value setting section 26 and a working moment Ma calculated by the working moment calculation section 26, a correction amount $\Delta Sh$ for the hoisting operation reference instruction signal Sa using the following equation:

$$\Delta Sh = g(\Delta M)$$

where $g(\Delta M)$ is a function of a moment difference $\Delta M$ and satisfies the conditions i) $g(\Delta M)=0$ when $\Delta M=0$, ii) $g(\Delta M)>0$ and $d\{g(\Delta M)\}/d(\Delta M)>0$ (monotone increase) when $\Delta M>0$, and iii) $g(\Delta M)<0$ and $d\{g(\Delta M)\}/d(\Delta M)<0$ (monotone decrease) when $\Delta M<0$. A suitable one of various functions including a linear function can be applied as the function $g(\Delta M)$. It is to be noted that also the correction amount $\Delta Sh$ may be calculated using a PID (proportional plus integral plus derivative) control calculation.

The hoisting operation instruction calculation section 27 calculates a final hoisting operation instruction signal Sh ($=Sa+\Delta Sh$) after correction which is a sum of a hoisting operation reference instruction signal Sa and a correction amount $\Delta Sh$ for the hoisting operation reference instruction signal Sa, and outputs the thus calculated hoisting operation instruction signal Sh to a hoisting motor output controlling apparatus 34.

The hoisting motor output controlling apparatus 34 executes driving control of a hoisting motor 36 provided for the hoisting apparatus 8 based on the corrected hoisting operation instruction signal Sh. In particular, the hoisting motor output controlling apparatus 34 executes driving control of the hoisting motor 36 such that the hoisting rope 6 is taken up at a speed, which increases in proportion to the magnitude of the hoisting operation instruction signal Sh, and then the dipper handle 2 is pivoted upwardly.

Thus, the hoisting motor output controlling apparatus 34, the hoisting operation reference instruction setting section 25, the hoisting operation instruction correction calculation section 26 and the hoisting operation instruction calculation section 27 constitute hoisting controlling means in the present invention.

Subsequently, an excavation controlling operation executed by the excavation controlling apparatus will be described.

In the present control, a basic characteristic of the dipper 1 upon excavation is utilized. While operation of the dipper 1 is divided into extension and contraction operations caused by a sliding movement of the dipper handle 2 and a pivoting operation caused by a taking up operation of the hoisting rope 6, the following can be said generally to the relationship between the operations and conditions of the dipper 1.

a. When the dipper 1 is extended, the resistance imparted from an object for excavation to the dipper 1 increases and the working moment Ma increases as much. On the contrary when the dipper 1 is contracted, the working moment Ma decreases.

b. The higher the speed of the hoisting operation of the dipper 1, the higher the rate at which the excavation moment increases.

Thus, in the present embodiment, the dipper handle angle A is divided into a plurality of sections as described hereinabove with reference to FIG. 3, and a suitable moment upper limit value Mr is set for each of the sections so that control suitable for each stage may be executed.

1) First step (initial stage of excavation; dipper handle angle A0 to A1): First, at an initial stage of excavation, the moment upper limit value Mr is set to a minimum value. Consequently, the moment difference $\Delta M = Mr - Ma$ presents a small value, and also the dipper handle extension instruction Sd and the hoisting operation instruction correction amount $\Delta Sh$ calculated by the dipper handle extension instruction calculation section 24 and the hoisting operation instruction correction calculation section 26, respectively, present low values. As a result, the dipper 1 and the dipper handle 2 are hoisted slowly while the extruding force of the dipper handle 2 is controlled to a minimum level. Consequently, the blade of the dipper 1 tries to move horizontally while readjusting the ground. Then, as the moment limit value increases, the blade of the dipper 1 bites deeply into the object for excavation.

When one of the following conditions is satisfied, the control advances from the first step to a next second step.

1. When a predetermined dipper handle angle is reached geometrically, the bottom of the dipper 1 scrubs the ground, and accordingly, the first step is stopped at an angle (angle A1 in the present embodiment) prior to the predetermined dipper handle angle.

2. The control advances to the second step at a point of time when the working moment Ma calculated by the working moment calculation section 22 reaches a preset moment value M1.

2) Second step (middle stage of excavation; dipper handle angle A1 to A3)

At a point of time when the first step comes to an end, the dipper 1 is filled by some amount with excavated substance, but the amount is not sufficient as yet. Therefore, after completion of the first step, the moment upper limit value is increased continuously from M1 to M2 within the region of the angle A1 to A2, and the upper limit value is maintained until the angle A3 is reached. Consequently, full-scale arcuate excavation is performed while the extending operation of the dipper handle 2 is adjusted. As such excavation operation proceeds, the dipper 1 is gradually filled with excavated substance.

3) Third step (latter stage of excavation; dipper handle angle A3 to A4)

As the excavation proceeds, the dipper 1 is filled with excavated substance while the dipper handle angle A increases until finally not the blade but the bottom of the dipper 1 is contacted with the ground, which allows no further effective excavation. Therefore, after the dipper pivoting angle reaches the predetermined angle A3, the control advances to a next third step, at which the moment upper limit value Mr is decreased from M2 to M3 within the region of the angle A3 to A4. Consequently, the biting amount of the dipper 1 gradually decreases, and finally at a point of time at which the dipper handle angle A reaches the angle A4, the excavation operation is ended. The ending angle A4 is suitably an angle at which the dipper handle 2 substantially extends horizontally, and if the moment upper limit value M3 at that point of time is restricted substantially low, then at the ending point of time, the dipper 1 will have been spaced away from the object for excavation with certainty.

As described so far, with the apparatus described above, since, taking notice of the close relationship between the actual excavation situation and the working moment Ma of the dipper 1, the sliding operation and the hoisting operation of the dipper handle 2 are controlled based on the working moment Ma, excavation by the dipper 1 can be automatically controlled appropriately only if a small number of detectors for detecting the working moment are used.

Further, in the present embodiment, since the moment limit value adjuster 17 for adjusting the set value set by the moment limit value setting section 23 and the dipper handle angle region adjuster 18 for adjusting the dipper handle angles A1, A2, A3 and A4 which make boundaries between the sections are provided, there is an advantage in that superior excavation can be assured for various types of the ground by suitably changing the A-Mr table in accordance with a condition of the object for excavation.

The excavation controlling apparatus may be constructed in a modified construction. With the excavation controlling apparatus described above, if the dipper 1 and the dipper handle 2 of the dipper shovel are extended excessively, then the bottom of the dipper 1 is acted upon by a repulsive force from the ground to cause such a disadvantage that, particularly at an initial stage of excavation, a working attachment or the working body 4 is jacked up, but at a middle stage of excavation, regular excavation is obstructed. Besides, where the reactive force acting upon the bottom of the dipper 1 then is represented by Fj, the moment radius of the dipper 1 around the shipper shaft 7 by Rj (refer to FIG. 2) and the movement by actual resistance to excavation by Md, the working moment Ma calculated actually by the working moment calculation section 22 is given by $Ma = Md - Fj \cdot Rj$, and the thus calculated working moment Ma is decreased by an amount of the reactive force. Consequently, setting only of the moment upper limit value Mr will not permit decision of an operation for preventing the jacking up described above and so forth.

Therefore, in the present modified excavation controlling apparatus, the moment limit value setting section 23 of the excavation controlling apparatus shown in FIG. 1 is modified such that it sets, in addition to the moment upper limit value Mr described above, a moment lower limit value Mo at a time so that, even when the calculated working moment Ma becomes lower than the lower limit value Mo, the dipper handle extension operation instruction Sd is decreased as much. With the modified excavation controlling apparatus, the disadvantage described above caused by excessive extension of the dipper handle 2 can be prevented by comparison between the calculated moment and the moment lower limit value Mo.

Another modification to the excavation controlling apparatus will be described subsequently. In order to reduce the cycle time of the dipper shovel described above, it is necessary to assure a hoisting speed as high as possible. Therefore, in the present modified excavation controlling apparatus, the moment limit value setting section 23 is modified such that the moment upper limit value is divided into a moment upper limit value Mrd for driving control of the dipper handle 2 (for driving control for sliding movement) and another moment upper limit value Mrh for hoisting control, and the moment upper limit value Mrh for hoisting control is set to a value higher than the moment upper limit value Mrd for dipper handle driving control (sliding driving control).

With the present modified excavation controlling apparatus, when the excavation resistance increases, the modified excavation controlling apparatus copes with such increase of the excavation resistance by restricting the extending operation of the dipper handle 2, and only when the effect is not sufficient, the excavation controlling apparatus can control so that the hoisting speed may be decreased. Accordingly, a higher hoisting speed than those of the excavation controlling apparatus described above can be achieved, and consequently, a decrease of the cycle time can be realized.

It is to be noted that, in the present invention, the driving sources for sliding movement and hoisting movement of the dipper handle are not limited to electric motors, but may be hydraulic apparatus operated, for example, by an engine. Further, the dipper supporting member driving means is not limited to a particular type such as the dipper handle driving apparatus of the rack and pinion type described hereinabove, and may be, for example, a dipper handle driving apparatus of the rope driving system.

Having now fully described the invention, it will be apparent to one of ordinary skill in the art that many changes and modifications can be made thereto without departing from the spirit and scope of the invention as set forth herein.

What is claimed is:

1. An excavation controlling apparatus for a dipper shovel which includes a dipper, a dipper supporting member having said dipper supported at an end thereof, a boom for supporting said dipper supporting member for sliding movement in its longitudinal direction and also for pivotal motion around an axis of a direction perpendicular to the direction of the sliding movement, dipper supporting member driving means for driving said dipper supporting member to slidably move in the longitudinal direction, a body for supporting said boom thereon, a hoisting member connected to said dipper supporting member at a position displaced from the axis of the pivotal motion and extending around an end of said boom, and hoisting means for taking up said hoisting member to pivot said dipper and said dipper supporting member upwardly, said excavation controlling apparatus comprising:

dipper supporting member angle detection means for detecting a dipper supporting member angle which is an angle of said dipper supporting member in its pivoting direction;

dipper supporting member position detection means for detecting a slide position of said dipper supporting member in its direction of sliding movement;

dipper posture calculation means for calculating a posture of said dipper based on detection values from said dipper supporting member angle detection means and said dipper supporting member position detection means;

hoisting force detection means for detecting a hoisting force of said dipper by said hoisting means;

moment calculation means for momentarily calculating a working moment of said dipper supporting member around the axis of the pivotal motion from a dipper posture from said dipper posture calculation means and the hoisting force from said hoisting force detection means;

moment limit value setting means for setting a moment upper limit value in response to the dipper supporting member angle from said dipper supporting member angle detection means;

dipper supporting member driving control means for comparing a moment limit value set by said moment limit value setting means and the working moment calculated by said moment calculation means with each other and controlling driving of said dipper supporting member driving means in accordance with a result of the comparison; and hoisting controlling means for comparing the moment limit value and the working moment calculated by said moment calculation means and controlling the hoisting operation of said hoisting means in accordance with a result of the comparison.

2. An excavation controlling apparatus for a dipper shovel according to claim 1, further comprising externally operable moment limit value adjustment means for modifying the moment limit value set by said moment limit value setting means.

3. An excavation controlling apparatus for a dipper shovel according to claim 1, wherein said moment limit value setting means simultaneously sets both of a moment upper limit value and a moment lower limit value.

4. An excavation controlling apparatus for a dipper shovel according to claim 1, wherein said moment limit value setting means simultaneously sets both of a moment limit value for dipper supporting member driving control used for driving control of said dipper supporting member driving means and another moment limit value for hoisting control used for hoisting control such that the moment limit value for hoisting control is higher than the moment limit value for dipper supporting member driving control.

* * * * *